US005625983A

United States Patent [19]

Lachance et al.

[11] Patent Number: 5,625,983

[45] Date of Patent: May 6, 1997

[54] DISMOUNTABLE ANCHORING DEVICE

[76] Inventors: Conrad Lachance, 6456, Des Érables, St-Émile, QC, Canada, G3E 1L4; Gaston Lachance, 107, Rue Robin, Montmagny, QC, Canada, G5V 4A7

[21] Appl. No.: 691,037

[22] Filed: Aug. 7, 1996

[30] Foreign Application Priority Data

Aug. 8, 1995 [CA] Canada ..... 2155580

[51] Int. Cl.[6] ..... E02D 5/74; E04H 15/62

[52] U.S. Cl. ..... 52/155; 135/118; 52/4

[58] Field of Search ..... 52/154, 155, 166, 52/4; 135/118

[56] References Cited

U.S. PATENT DOCUMENTS

| | | | |
|---|---|---|---|
| 425,325 | 4/1890 | Jaques | 135/118 |
| 2,156,021 | 4/1939 | Little | 135/118 |
| 4,063,567 | 12/1977 | Martin et al. | 135/118 |

FOREIGN PATENT DOCUMENTS

| | | | |
|---|---|---|---|
| 517809 | 5/1921 | France | 52/155 |
| 362665 | 10/1922 | France | 52/155 |
| 1315552 | 12/1962 | France | 135/118 |
| 3814387 | 11/1988 | Germany | 135/118 |
| 0022461 | of 1909 | United Kingdom | 135/15 |
| 0010173 | of 1910 | United Kingdom | 135/118 |

*Primary Examiner*—Carl D. Friedman
*Assistant Examiner*—Yvonne Horton-Richardson

[57] ABSTRACT

In an anchoring device to be driven into the ground, important features are that it be dismountable, safe and easy to manipulate. In this invention, the anchoring device is provided with a cross with two sliding members, two rods with pointed ends and a head, the heads being equipped with superposable eyelets that may be padlocked. The eyelets allow the anchoring of an object which one wants to insure the stability of and even its protection against theft. The anchoring device may comprise two angle irons, a first of which allowing the anchoring of a tridimensional object and a second comprising a tube to receive and orientate one of the two members of the cross.

13 Claims, 8 Drawing Sheets

DISMOUNTABLE ANCHORING DEVICE

BACKGROUND

1. Field of Invention

This invention belongs to the family of anchoring devices, particularly one of the safety types, to anchor objects one wants to insure the stability of, or even protection against theft.

2. Description of the Prior Art

The search for means for anchoring objects to the ground, such as for the firm holding of temporary transportable shelters, is a constant preoccupation. A review of the prior art has revealed the following patents:

U.S. Pat. No. 425,385 McKay, W. W. April 1890. This patent describes an anchoring device comprising a ring forming a large circumferential band, pierced by two holes at 30° from a vertical diametral axis; the holes making a V with a third hole placed opposite to the other two. Rods are inserted in these two holes, to make two angular poles. The ring is used to secure a rope, the tension of which putting pressure onto the rods, thus preventing their removal.

GB 0,022,461 Gartland et al, October 1909. This patent shows an anchoring device comprising a ring that has two holes at 30°, diametrically opposed to two other holes pierced in the ring wall and forming an X with the first two holes. Rods are diagonally inserted in these holes to form angular poles. A third vertical rod fixes the ring into the ground. This invention has an application where one of the rods has a bulge that keeps it inside the ring and makes the third rod useless because the captive rod can be driven into the ground. This device is not easily padlocked.

U.S. Pat. No. 4,063,567 Martin et al, 20 Dec. 1977. This patent illustrates a ground anchoring device that prevent tents exposed to strong winds to collapse. It is made of an elongated rod, with a curved section FIG. 4*a*, on which a hook can be attached on the superior part, and that is diagonally driven into the ground and held in place by a nail driven into the ground perpendicularly to the rod. This device cannot be easily dismantled and cannot be padlocked.

DE 3814-387-A Schecker, R, May 1987. This patent shows an anchoring device that holds in position sheets of plastic film used in greenhouses. this device comprises an angle iron on which are welded two pipes in which are inserted two rods driven in the ground. The rods are placed apart and their position provides no means for fixing them together permanently.

OBJECTS AND ADVANTAGES

The main objective of this invention is to provide a portable, dismountable anchoring device driven into the ground, that allows any object to be anchored, using a flexible chord or an adapter that can anchor any tridimensional object.

Another objective is to provide a portable anchoring device that can be used with a padlock, making easier the dismantling of the device or the removal of objects of which the user wants to insure the stability, or even its protection against theft.

Another objective of this invention is to provide a portable device that is light, not bulky, easy to use and inexpensive. More generally, it is to supply for general use a portable anchoring device that comprises a first and a second rods to be driven into a strong surface, the device comprising in combination:

a sliding restraining sleeve comprising a first and a second tubes to be superposed and positioned crosswise, the first tube to insert the first rod and the second tube to insert the second rod, both tubes being firmly tied together, an adapter comprising means for tying a tridimensional object to the strong surface and means for slidingly tying the first tube, the crosswise insertion of rods through the first and second tubes and through the strong surface causing the anchoring of the object to the strong surface.

SUMMARY OF THE INVENTION

A portable anchoring device that comprises a first and second. rods, each comprising a superior end, a middle part and an inferior end, the inferior end intended to be driven into the ground, a cruciform sliding restraining sleeve forming a cross above the ground, the branches of the cross forming a first tube to insert the first rod and a second tube to insert the second rod, both tubes being firmly tied together, the superior end of each rod comprising an eyelet fixed permanently to the superior end and adapted to be superimposed upon the eyelet of the mating rod, the superimposed eyelets providing a common opening to place a padlock or a safety chain.

Each rod has certain characteristics: the rods have a rough surface, the superior end of each rod allows percussion; the middle part allows sliding and the inferior end comprises a sharp point. In addition, the second rod comprises a safety catch preventing the removal of the rod from the second tube, after its insertion.

The eyelets are placed face to face and oriented along a plane corresponding to the plane of the rods; each of the eyelets has undergone a twisting at 90°, one to the left, the other to the right, the eyelet of a rod inserted in a tube facing a user, covering the eyelet of a rod inserted in the opposite tube.

Also it is an object to provide an adapter to anchor any tridimensional object, such adapter comprising an angle iron, a side of the angle iron being fixed on one face of the tridimensional object and the second side being provided with an assembling tube joining with the tying device.

BRIEF DESCRIPTION OF THE DRAWINGS

The present invention will be further understood from the following description with reference to the drawings in which.

DESCRIPTION OF THE PREFERRED EMBODIMENT

Figure 1:
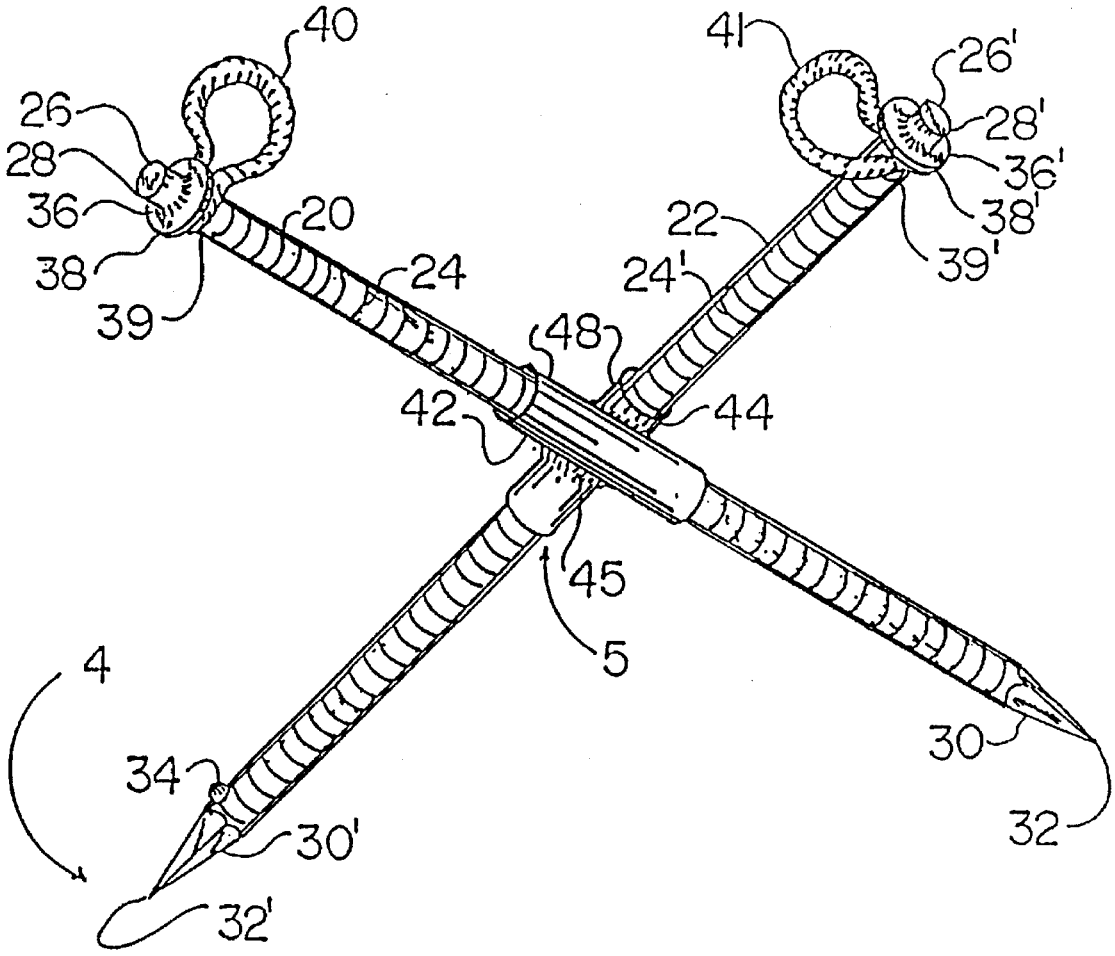
FIG. 1 is a perspective view of the portable anchoring device

The preferred embodiment of the invention is illustrated in FIG. 1 where the same characterizing elements are identified by the same numbers.

Figure 5:
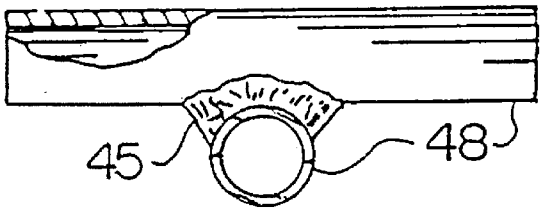
FIG. 5 is an enlarged view, partially sectioned, of section 5 of FIG 1.
Figure 4:
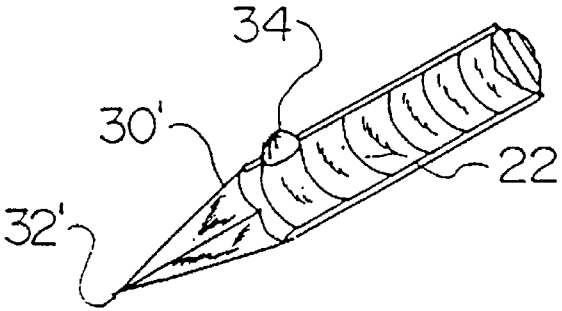
FIG. 4 is an enlarged view in the area of arrow 4 of FIG. 1

The device illustrated in FIG. 1 comprises two metallic rods, a first rod 20 angularly oriented from left to right, from top to bottom, and a second rod 22 oriented from right to left, from top to bottom. The first rod 20 is covered with asperities and comprises a flat part 26, at a superior end 28, and a point 30 at an inferior end 32. The second rod 22 is similar to the first rod 20, but for a safety catch 34 (FIG. 4) placed above the point $30^1$ of the inferior end $32^1$ of the second rod 22. The superior end 28 of both rods is obstructed by a weld 36 of a metallic disc 38 slightly sunken, to which is welded a first metallic eyelet 40 of the first rod 20, the first metallic eyelet 40 resulting from the twisting of a metallic bow 39 originally placed in the same direction as the metallic disc 38. For the first rod 20, the first metallic eyelet 40 results from the twisting of the bow counterclockwise, while for the second rod 22, a second metallic eyelet 41 results from the twisting of the bow clockwise. Two tubes, of a diameter superior to the one of the rods, a First tube 42, positioned from left to right and facing the user and a second tube 44, positioned from right to left, welded together in a cross-shaped form 45 (FIG. 5) are used as a restraining sleeve 48 for the two rods. The first rod 20, inserted in the first tube 42, remains detachable while the second rod 22, inserted in the second tube 44 is blocked by the safety catch 34.

Figure 2:
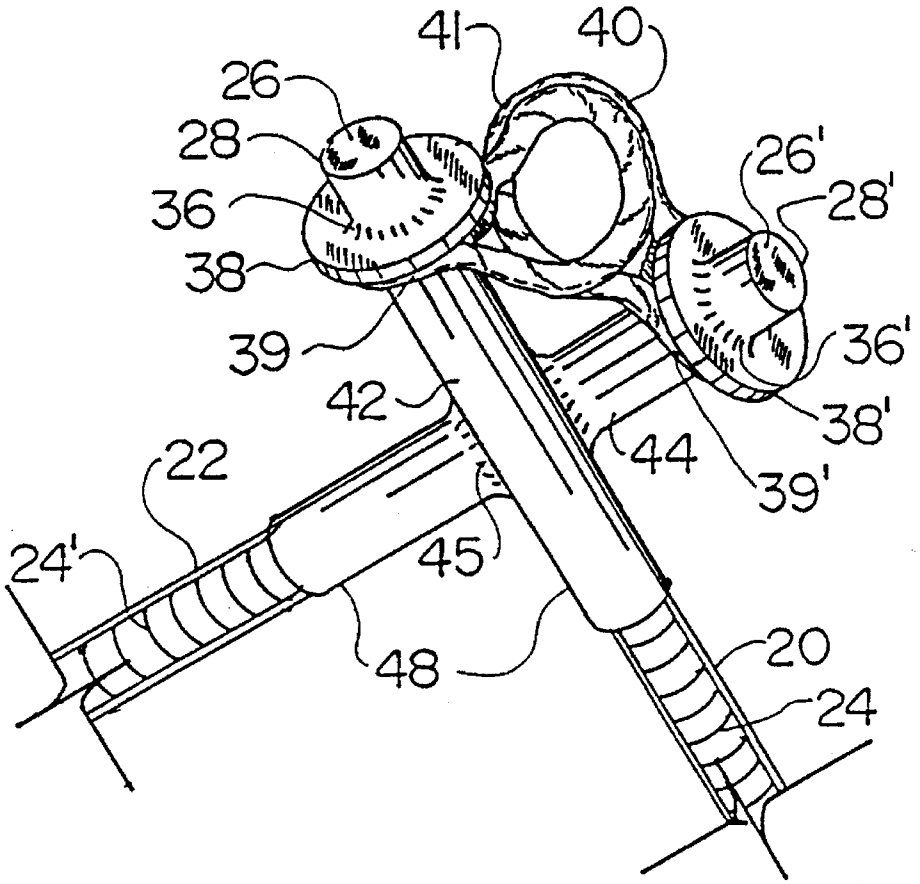
FIG. 2 is a perspective view of the device of FIG. 1 in use
Figure 3:
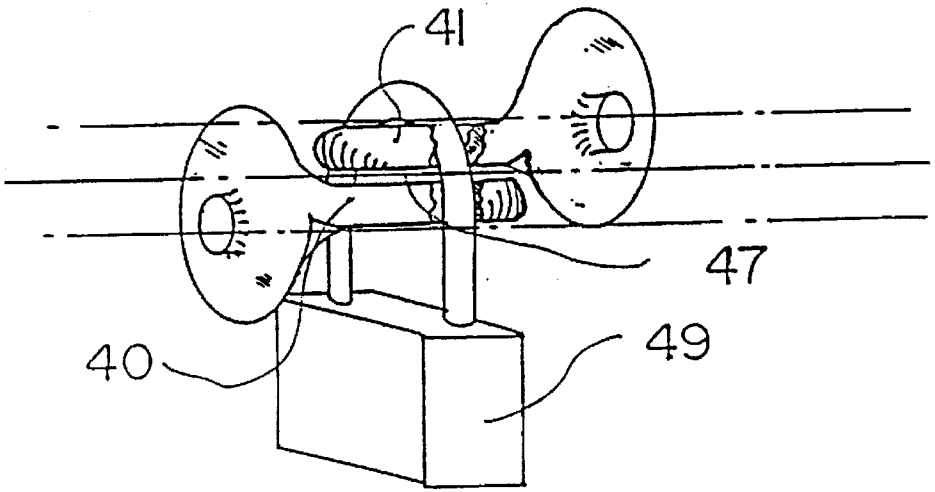
FIG. 3 is a high angle view of the superimposed eyelet 40 of FIG. 1

FIG. 2 illustrates the restraining sleeve 48 of the superior end 28 of the first and second rods 20 and 22, the first and second metallic eyelets 40 and 41, positioned in an opposed and parallel direction, so the first metallic eyelet 40 of the rod 20 superposed itself on the second metallic eyelet 41 of the second rod 22 to create a single eyelet 47 (FIG. 3) that can be tied with a padlock 49 (FIG. 3), tying the first rod 20 to the second rod 22 at their superior ends 28 and 28'.

Figure 6:
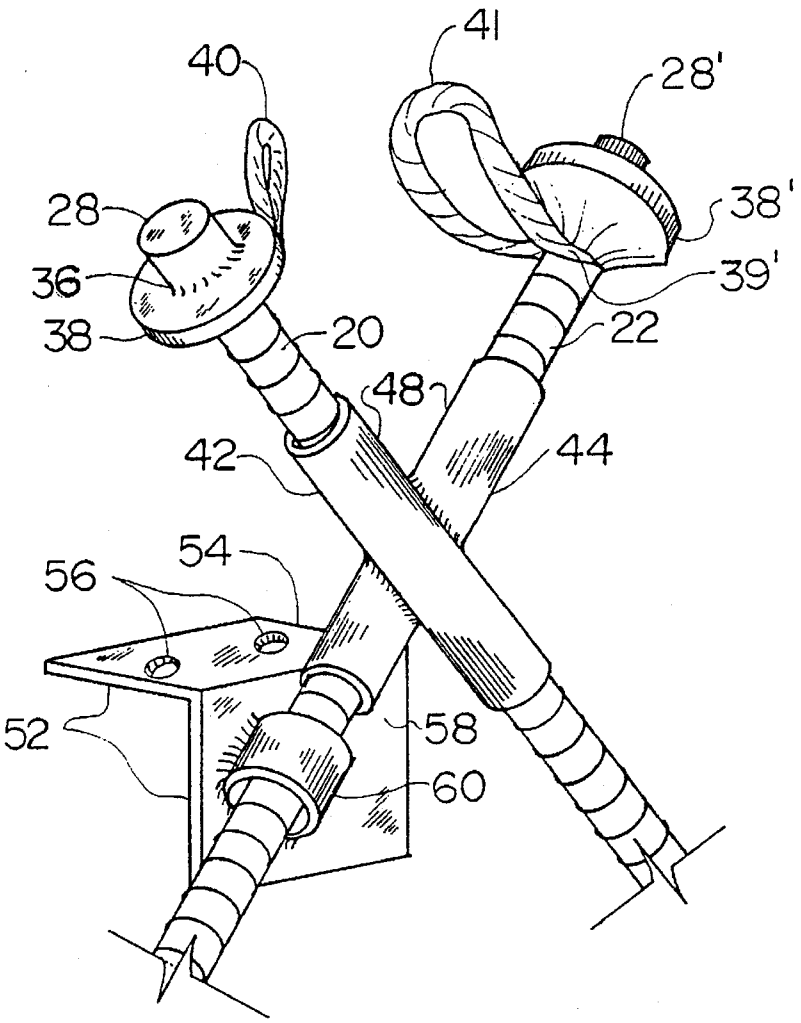
FIG. 6 is a perspective view of the device comprising an adapter 52.
Figure 7:
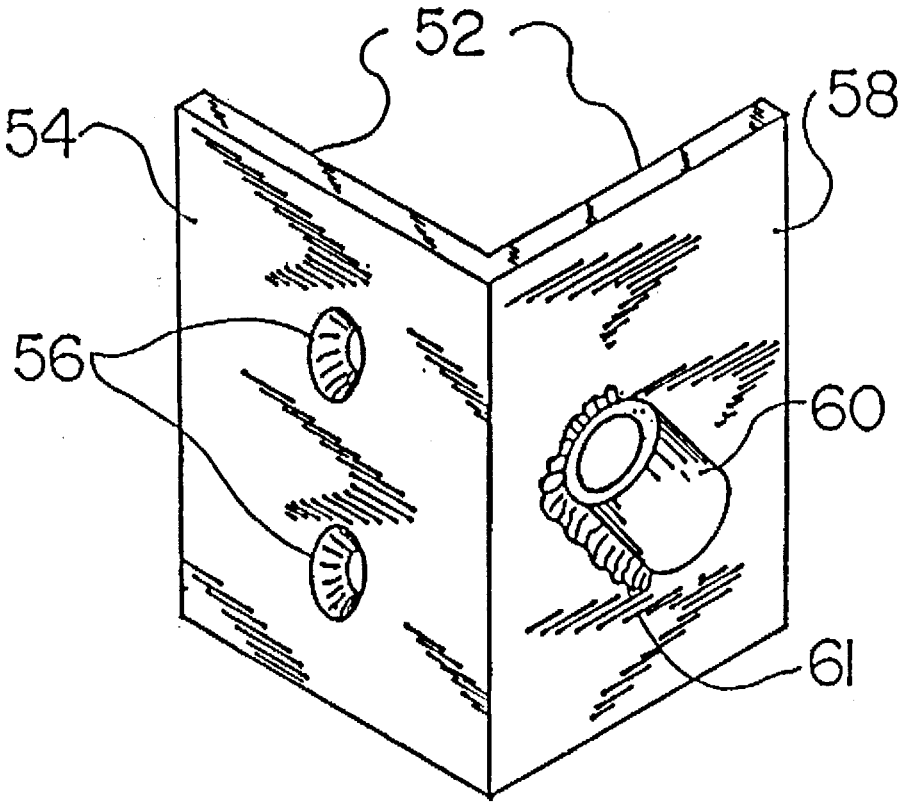
FIG. 7 is an enlarged view of adapter 52 of FIG. 6, turned to the left, FIGS. 8A, B, C, D show the installation of the adapter 52.

A variant of this embodiment comprises an adapter 52 illustrated in FIG. 6. This adapter 52 shown in perspective (FIG. 7) is an L-shaped angle iron of which a perforated left side 54 comprises two holes 56 placed equidistantly on a median line and of which a right side 58 has an assembly tube 60 fixed by a sleeve weld 61 on its centre and positioned diagonally from left to right, from top to bottom. Another embodiment has the tubes located within a monolithic block 62 comprising two diagonal apertures, placed perpendicularly and in superimposed planes. This monolithic block 62 may comprise means for tying to a structure to fix in position. Two curved rods 64 with formed eyelets 66 a their extremities, comprise a percussion disk 68 and a collar closed at the junction between the rod and the eyelet.

METHOD OF UTILIZATION

This portable anchoring device may be used with or without the adapter 52. Without it (FIG. 1) the method for using the device comprises these steps:

- place the restraining sleeve 48 with the first tube 42 free, facing the user;
- slide the restraining sleeve 48 until achieving an X-shaped position, the inferior end $32^1$ of the second rod 22 positioned below and to the left of the user;
- retract the second rod 22 inserted in the second tube 44 until the safety catch 34 is in contact with the tube 44;
- press the inferior end $32^1$ of the second rod 22 against the ground, at this time the second rod 22 will have a 45° axis with the ground.
- drive the second rod 22 into the; ground, according to the angle defined by the second tube 44 of the restraining sleeve 48, with the assistance of a hammering tool acting upon the flat disk 26',
- insert the first removable rod 20 into the first tube 42 free and drive it into the ground, as for the second rod 22, according to the angle defined by the first tube 42 of the restraining sleeve 48, hammering onto the flat disk 26;
- press the rods into the ground, until the superior ends 28 and $28^1$ are at the level of the restraining sleeve 48;
- turn the first and second metallic eyelets 40 and 41 of the first and second rods 20 and 22 and place them so the first eyelet 40 of the first rod 20, facing the user, covers the second eyelet 41 of the second rod 22 (FIGS. 2–3),
- padlock the first and second metallic eyelets 40 and 41.

In case where the material is likely to offer resistance when turning the rods 20 and 22 when totally driven into the ground, the user should see that the eyelets 40 and 41 are in an appropriate position before driving in the rod completely into the ground.

Figure 8B:
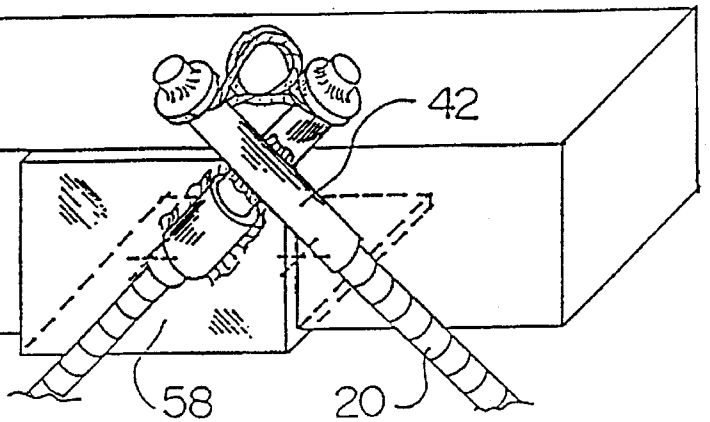
Figure 8A:
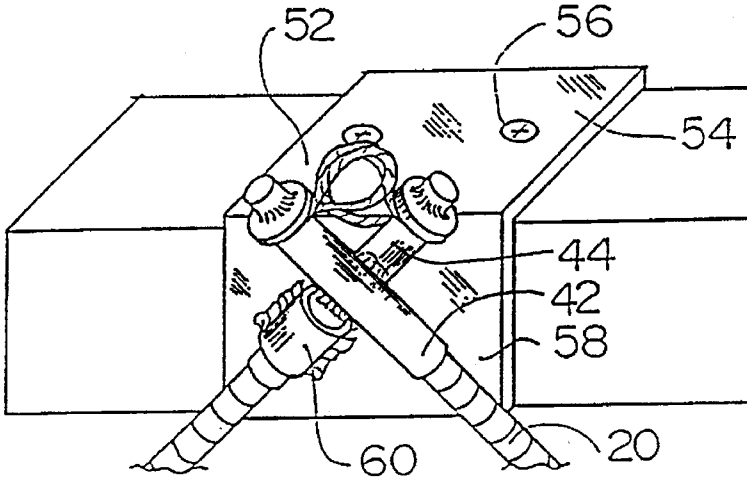
Figure 8D:
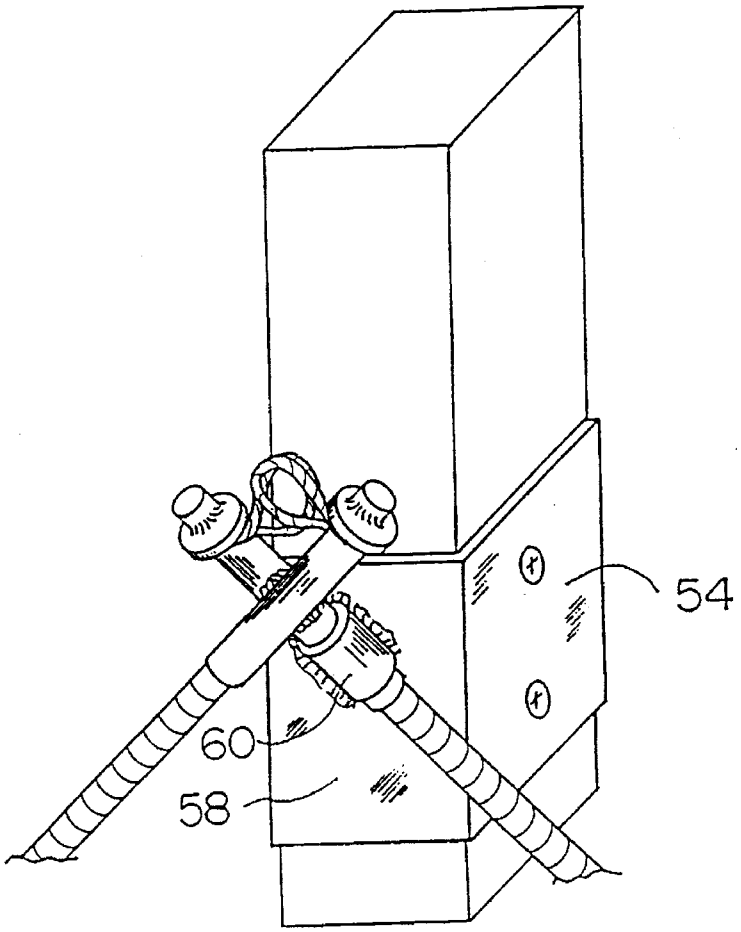
Figure 8C:
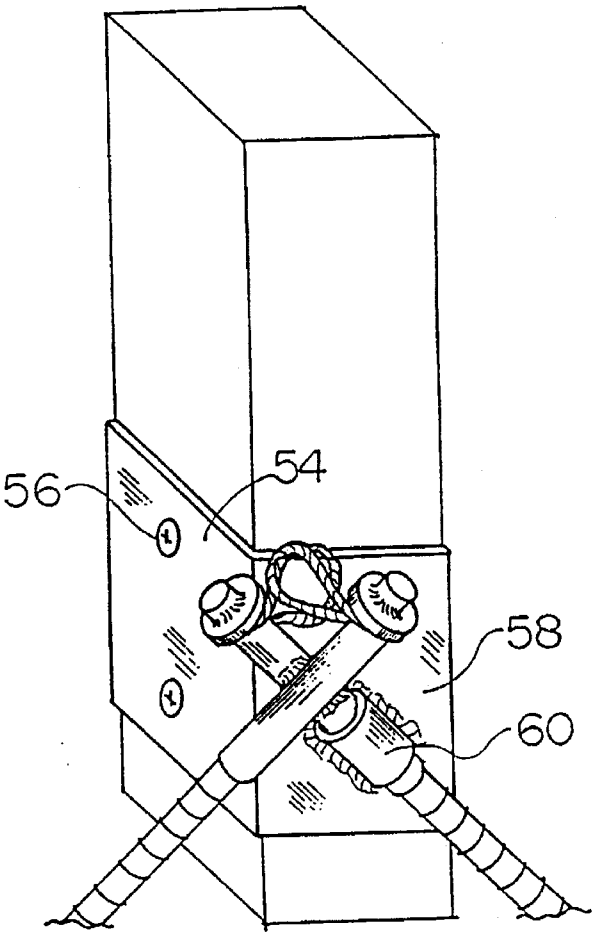
Figure 9A:
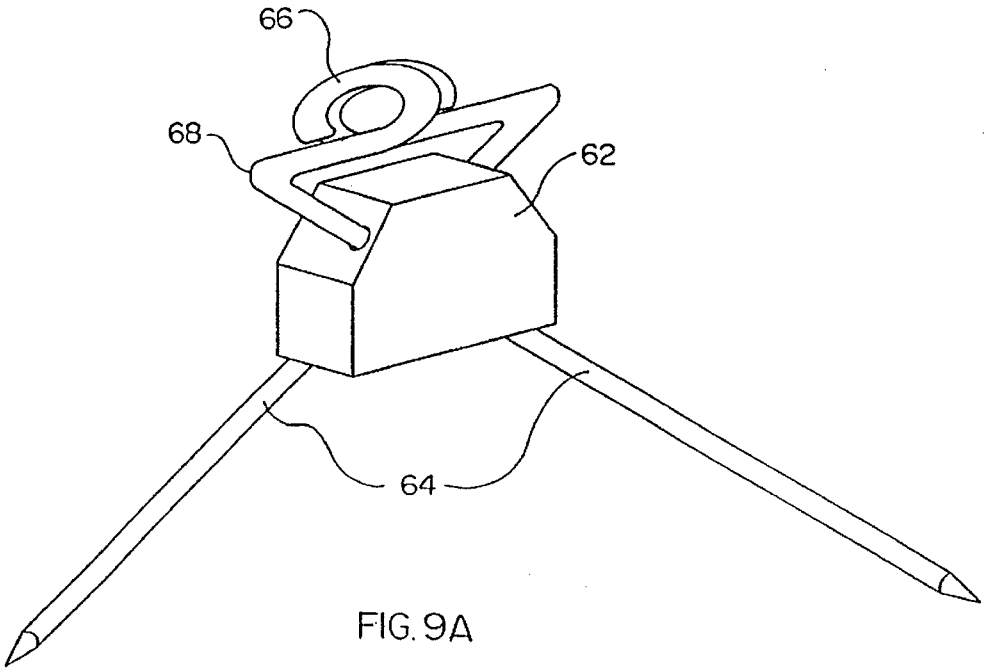
FIG. 9A and 9B are alternative views.
Figure 9B:
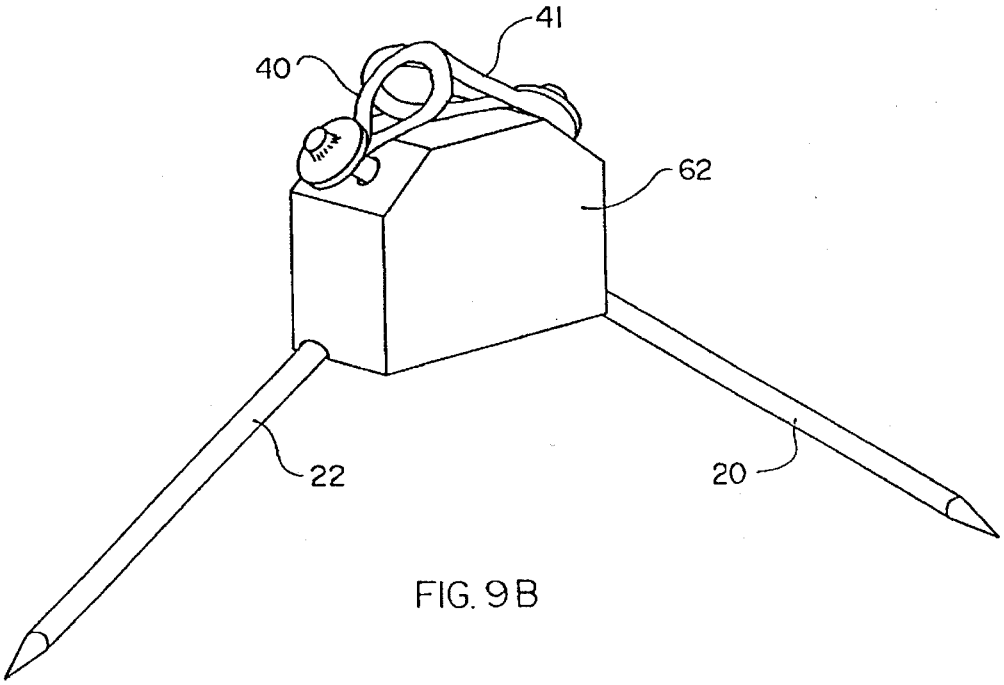

When using the adapter 52 (FIG. 6), the method varies according to the orientation of the adapter 52; for instance when in superior horizontal position (FIG. 8A) and when in inferior horizontal position (FIG. 8B), the second tube 44 of the restraining sleeve 48 will be sled in the assembly tube 60 from right to left, consequently the first rod 20 will slide in the first tube 42 from left to right. On the other hand, in left position (FIG. 8C) and in vertical right position (FIG. 8D), the second tube 44 of the restraining sleeve 48 will be inserted into the assembly tube 60 from left to right and consequently the first rod 20 will be inserted in the first tube 42 from right to left So when the adapter 52 (FIG. 1) is used, the utilization mode comprises the following steps:

- put the adapter 52 onto a tridimensional object, in a plane either horizontally superior FIG. 8A, horizontally inferior FIG. 8B, vertically left FIG. 8C or vertically right FIG. 8D and secure it with bolts in the holes 56. When in horizontally superior position the assembly tube is in position at 225° anticlockwise to the junction line of the two parts of the angle iron, in horizontally inferior position the angle being 45°, in vertical left position, the angle being −45° and in a vertically right position the angle being of 135°;
- place the first tube 42 facing the user to direct the first rod at the required angle to circumvent obstacles;
- retract the second rod 22 inserted in the second tube 44 until the safety catch 34 is in contact with the tube 44;
- press the inferior end $32^1$ of the second rod 22 against the ground, at this time the second rod 22 will have its longitudinal axis at 45° with the ground;
- drive the second rod 22 into the ground, according to the angle defined by the second tube 44 of the restraining sleeve 48, with the assistance of a hammering tool against the flat disk $26^1$;
- insert the first removable rod 20 into the other tube 42 and drive it into the ground, as for the second rod 22, according to the angle defined by the first tube 42 of the restraining sleeve 48, while hammering onto the flat disk 26;
- press the rods into the ground, until the superior ends 28 and $28^1$ are at the level of the restraining sleeve 48;
- turn the first and second metallic eyelets 40 and 41 of the first and second rods 20 and 22 and place them so the first eyelet 40 of the first rod 20 facing the user, covers the second eyelet 41 of the second rod 22;
- padlock the first and second metallic eyelets 40 and 41.

While the present invention has been shown in the drawings and fully described above with particularity and detail in connection with what is presently deemed to be the most practical and preferred embodiment(s) of the invention; it will be apparent to those of ordinary skill in the art that many modifications thereof may be made without departing from the principles and concepts set forth herein. Hence, the proper scope of the present invention should be determined only by the broadest interpretation of the appended claims so as to emcompass all such modifications and equivalents.

Other embodiments are possible and limited only by the scope of the appended claims:

| PARTS LIST | |
|---|---|
| 20 first rod | 62 monolithic block |
| 22 second rod | 63 curved rod |
| 24 asperities | 66 formed eyelet |
| 26 flat disk | 68 percussion disk |
| 28 superior end | |
| 30 point | |
| 32 inferior end | |
| 34 safety catch | |
| 36 weld | |
| 38 metallic ring | |
| 39 metallic arch | |
| 40 first metallic eyelet | |
| 41 second metallic eyelet | |
| 42 first tube | |
| 44 second tube | |
| 45 cross-shaped weld | |
| 47 single eyelet | |
| 48 restraining sleeve | |
| 49 padlock | |
| 52 adapter | |
| 54 perforated side | |
| 56 holes | |
| 58 assembled face | |
| 60 assembly tube | |
| 61 tube welding | |

I claim:

1. A dismountable anchoring device comprising:

a first and a second rigid rods, each of said rods comprising a superior end, a middle part and an inferior end, said inferior end intended to be driven into a ground, a sliding restraining sleeve comprising two first and second tubes placed in the way of a cross, in two superimposed planes, said first tube to receive said first rod and said second tube to receive said second rod, said superior end of each of said rods comprising an eyelet fixed permanently to said superior end, when said inferior ends are in a position of being driven completely into said ground, said inferior ends being fully spread out, thereby said superior ends being in a position next to each other and said eyelets superimposed, said superimposed eyelets providing a common opening for inserting a padlock.

2. The device of claim 1, wherein said tubes are inside a monolithic block comprising two diagonal apertures, placed perpendicularly and in superimposed planes.

3. The device of claim 2, wherein said monolithic block comprises means for tying to a structure, to immobilize said structure.

4. The device of claim 1, wherein said first and second rods comprise a rough surface, for frictionnally engaging into said ground, wherein said superior end is provided with a hammer end for receiving percussion, wherein said middle part comprises means for sliding within said restraining sleeve and said inferior end comprises means for penetrating into said ground so that when said superior end is hammered, said middle part slides through said cross restraining sleeve and said inferior end penetrates into said ground, in a cross, diverging direction, and may not be easily retrieved vertically.

5. The device of claim 4, wherein said second rod, further comprises a safety catch on said inferior end, said safety catch preventing the removal of said rod from said second tube after being inserted.

6. The device of claim 1, wherein said superposed rods carry a pivoting axis passing radially at a cross junction between said rods, and wherein said eyelets of said rods are placed face to face and around an eye axis parallel with said pivoting axis of said rods.

7. The device of claim 6, wherein each of said eyelets has undergone a twisting of 90° in an opposite direction, one to the left, the other to the right, so that said eyelets may be superimposed, so that their apertures coincide.

8. The anchoring device of claim 2 further comprising an adapter to anchor a tridimensional object, said adapter comprising an angle iron having a first side comprising means for fixing to one face of said tridimensional object and a second side joined to one of said tubes.

9. A dismountable anchoring device comprising:

a first and second rigid rods to be driven into the ground and a sliding restraining sleeve (48) to insert said rods crosswise, said restraining sleeve comprising a first tube (42) overhanging a second tube (44), said first and second tubes being firmly fixed together crosswise, said first tube to receive said first rod and said second tube to receive said second rod, said first rod comprising a superior end to allow percussion, a middle part to allow sliding through said restraining sleeve (48) and an inferior end comprising means for penetrating into said ground, said superior end comprising a first eyelet (40) sufficiently wide to prevent entering into said tube, said first rod being mobile within said first tube, as for said second rod within said second tube, said first eyelet of said first rod comprising means for superposition, at least partly, on said second eyelet of said second rod, superposition of said first and second eyelets creating a single aperture to install means for locking.

10. The device of claim 9 wherein said means for superposition comprise the twisting of said first eyelet counterclockwise and the twisting of said second eyelet clockwise.

11. The device of claim 9 further comprising an adapter to anchor a tridimensional object said adapter comprising an angle iron comprising a first side to be fixed to said tridimensional object, and a second side having means for supporting said sliding restraining sleeve.

12. The device of claim 11 wherein said first side comprises a perforated surface to be fixed to a plane of said tridimensional object, said second side comprising an assembled face and wherein said means for supporting comprise an assembly tube fixed to said assembled face.

13. A dismountable anchoring device comprising a first (20) and second (22) rigid rods to be driven into a strong surface, said device comprising in combination:

a sliding restraining sleeve (48), comprising a first (42) and a second (44) tubes to be superposed and positioned crosswise, said first tube (42) to insert said first rod (20) and said second tube (44) to insert said second rod (22), said tubes being firmly tied together, an adapter (52) comprising an L-shaped angle for tying a tridimensional object to said strong surface, said L-shaped angle having a first face and a second face, said adapter further comprising sliding means for tying to said first tube (42), said sliding means fixed diagonally on said first face of said L, said second face of said L being fixed to said tridimensional object, the insertion of said rods crosswise through said first and second tubes and said strong surface, anchoring said tridimensional object to said strong surface.

* * * * *